United States Patent [19]

Lewis, III et al.

[11] 4,210,442

[45] Jul. 1, 1980

[54] ARGON IN THE BASIC OXYGEN PROCESS TO CONTROL SLOPPING

[75] Inventors: Jennings B. Lewis, III, Putnam Valley, N.Y.; Peter P. Kelly, Grosse Ile, Mich.

[73] Assignee: Union Carbide Corporation, New York, N.Y.

[21] Appl. No.: 10,316

[22] Filed: Feb. 7, 1979

[51] Int. Cl.[2] ..... C21C 5/32

[52] U.S. Cl. ..... 75/60; 75/59

[58] Field of Search ..... 75/59, 60

[56] References Cited

U.S. PATENT DOCUMENTS

| | | | |
|---|---|---|---|
| 3,169,058 | 2/1965 | Nelson | 75/59 |
| 3,953,199 | 4/1976 | Michaelis | 75/60 |
| 3,960,546 | 1/1976 | Rote | 75/60 |
| 4,004,920 | 1/1977 | Fruehan | 75/60 |
| 4,089,677 | 5/1978 | Spenceley | 75/60 |

OTHER PUBLICATIONS

Chernyatevick et al., "Mechanism of the Formation of Ejections & Spatter from Basic Oxygen Furnaces," *Steel in the USSR,* Oct. 1976, vol. 6, pp. 544–547.

V. I. Baptizmansku et al., "Causes of Ejections and of Lancing Conditions in Basic Oxygen Furnace," *Stal.* Apr. 1967, pp. 309–312.

Stravinskas et al., "Influence of Operating Variable or BOF Yield," *I & SM,* May 1978, pp. 33–37.

Shakirov et al., "The Mechanism of the Foaming of Basic Oxygen Furnace Slag," *Steel in the USSR,* Jun. 1976, vol. 6.

Zarvin et al., "Some Features of Injection in the Melting of Steel in 350—Ton Basic Oxygen Furnaces," *Steel in the USSR,* Dec. 1976, vol. 6, pp. 659–662.

*Primary Examiner*—P. D. Rosenberg

*Attorney, Agent, or Firm*—Lawrence G. Kastriner; Warrick E. Lee, Jr.

[57] ABSTRACT

Slopping of emulsion from the mouth of a basic oxygen refining vessel is prevented during oxygen refining by introducing inert gas into the vessel when slopping is imminent or has begun. The preferred method is to inject argon in admixture with oxygen through the oxygen lance at a flow rate of from 5 to 30 percent of the oxygen flow rate.

6 Claims, 2 Drawing Figures

ARGON IN THE BASIC OXYGEN PROCESS TO CONTROL SLOPPING

BACKGROUND

This invention relates to an improvement in a process for refining a ferrous melt by blowing oxygen into the melt from above the melt surface, commonly called the "basic oxygen process". More specifically, this invention relates to a method for preventing or minimizing the overflow of material from the mouth of the vessel which tends to occur during conventional practice of the basic oxygen process.

Oxygen is used to decarburize the melt by reacting it with the carbon contained therein to form CO, which escapes from the vessel as a gas. Typically, the unrefined ferrous melt also contains silicon and other oxidizable elements such as manganese and phosphorus, the oxides of which form liquids or solids which form a separate slag phase. Lime and other materials such as dolomitic lime are added into the vessel to form a basic slag.

It is well known to those skilled in the art that refining is most efficient if what is referred to in the art as an "emulsion" is formed above the melt during the oxygen blow. The emulsion is a foam-like substance comprising a complex mixture of liquid oxides, gas bubbles (primarily CO), solid oxide particles, and droplets of liquid metal. The volume of the emulsion is ideally several times that of the melt; see FIG. 1.

A problem in the basic oxygen process is that the volume of the emulsion is difficult to control. Frequently, the emulsion becomes so large that it slops, that is, it fills the head space of the vessel and overflows from the mouth of the vessel, causing loss of valuable metal and production time, and necessitating time-consuming clean-up.

Prior methods of controlling slopping include the following steps or various combinations thereof:

(1) decreasing the oxygen flow; see for example, Stravinskas et al, "Influence of Operating Variables on BOF Yield", I & SM, May 1978, pp. 33–37;

(2) increasing the oxygen flow; see for example, Zarvin et al, "Some Features of Injection in the Melting of Steel in 350-Ton Basic Oxygen Furnaces", *Steel in the USSR*, December 1976, Vol. 6 pp. 659–662;

(3) lowering the lance position; see for example, Shakirov et al, "The Mechanism of the Foaming of Basic Oxygen Furnace Slag," *Steel in the USSR*, June 1976, Vol. 6;

(4) raising the lance position; see for example, Chernyatevich et al, "Mechanism of the Formation of Ejections and Spatter from Basic Oxygen Furnaces", *Steel in the USSR*, October 1976, Vol. 6, pp. 544–547;

(5) changing the lance nozzle design; see for example, Baptizmanskii et al, "Causes of Ejections and of Lancing Conditions in Basic Oxygen Furnace", *Stal*, April 1967, pp. 309–312; and (6) modifications to the amount, ingredients, and timing of flux addition; see for example, Chernyatevich et al, supra. Unfortunately, none of the above methods are very reliable, some are complicated, and some require production delay.

OBJECTS

Accordingly, it is an object of this invention to provide a method for preventing slopping during basic oxygen refining of molten ferrous metal that is simpler and more reliable than those of the prior art.

It is another object of this invention to provide a method for preventing slopping during basic oxygen refining of molten ferrous metal without causing production delays.

SUMMARY OF THE INVENTION

These and other objects are achieved by the present invention which comprises:

In a process for refining molten ferrous metal contained in a vessel by blowing oxygen into the melt from above the melt surface whereby an emulsion is formed above said surface, the improvement comprising:

preventing slopping of said emulsion from said vessel by:

(a) blowing an inert gas into the vessel when slopping is imminent or has begun, at a flow rate sufficient to stop slopping, while continuing to blow with oxygen, and (b) ceasing the blow of inert gas into the vessel when slopping has stopped or is no longer imminent.

The preferred inert gas flow rate is from 5 to 30 percent of the oxygen flow rate. The preferred method of introducing inert gas is through the oxygen lance admixed with the oxygen.

The term "inert gas" as used throughout the present specification and claims is intended to mean a gas or mixture of gases other than oxygen. Argon is the preferred inert gas.

The term "slopping" as used throughout the present specification and claims is intended to mean the overflowing of emulsion from the mouth of the refining vessel.

As used in the claims "preventing slopping" is intended to mean preventing further slopping by causing it to cease quickly or averting slopping altogether.

THE DRAWINGS

DETAILED DESCRIPTION OF THE INVENTION

Figure 1:
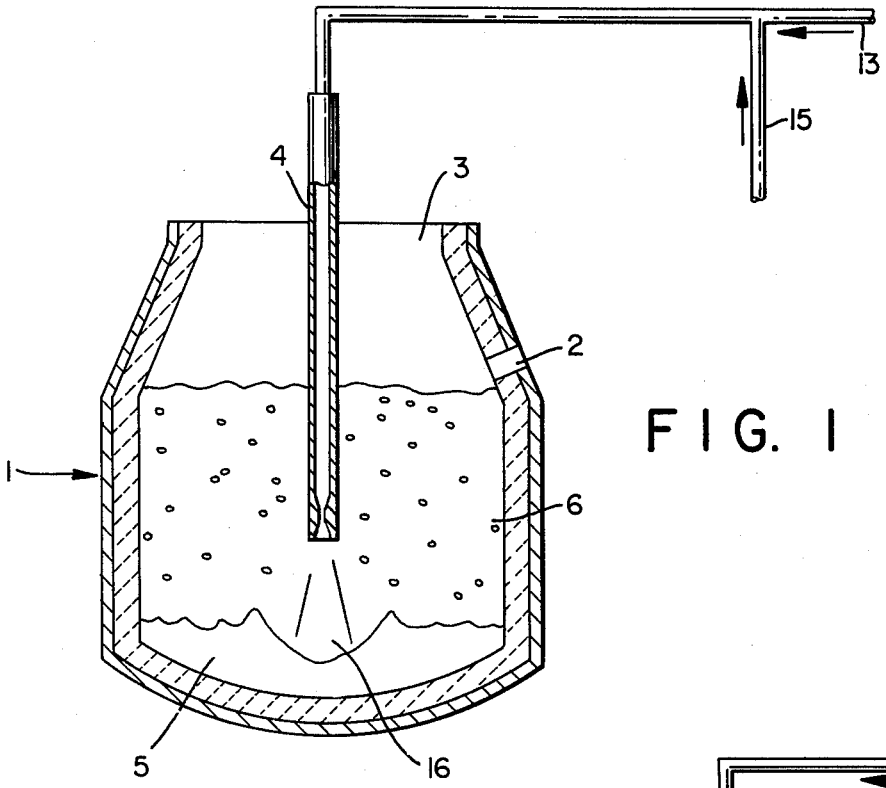
FIG. 1 illustrates a basic oxygen refining vessel during an oxygen blow with an emulsion of a desirable size.

In FIG. 1 a basic oxygen refining process is taking place in a conventional, refractory lined basic oxygen vessel 1. The vessel has a tap hole 2 located near its top and a mouth 3 at its top. A lance 4 is used to inject gases into the melt. The lance, which is connected to oxygen supply line 13, can be raised so that the vessel can be tilted for removing its contents.

In the absence of slopping, the apparatus of FIG. 1 functions as follows. First, molten pig iron, scrap, lime, and other materials well known to those skilled in the art are charged to the vessel. Oxygen is then blown into melt 5, from above the melt surface through lance 4, causing a depression 16 to form in the melt surface. Oxidizable elements in the melt react with oxygen. Carbon in the melt reacts with oxygen to form CO gas bubbles which rise to the surface of the melt and escape from the mouth of the vessel. After roughly ⅓ of the blowing time has elapsed, emulsion 6 forms, composed of a complex mixture of liquid oxides, gas bubbles, solid oxide particles, and droplets of liquid metal. The metal drops contained in the emulsion have a very large specific surface area, which promotes desirable reaction between oxygen and impurities in the melt. Generally, in the latter stages of the oxygen blow, the emulsion subsides. Refining with oxygen is continued until the melt has the desired composition. The flow of oxygen is then stopped, lance 4 is raised above mouth 3, and the refined melt is poured from the vessel through tap hole 2.

Figure 2:
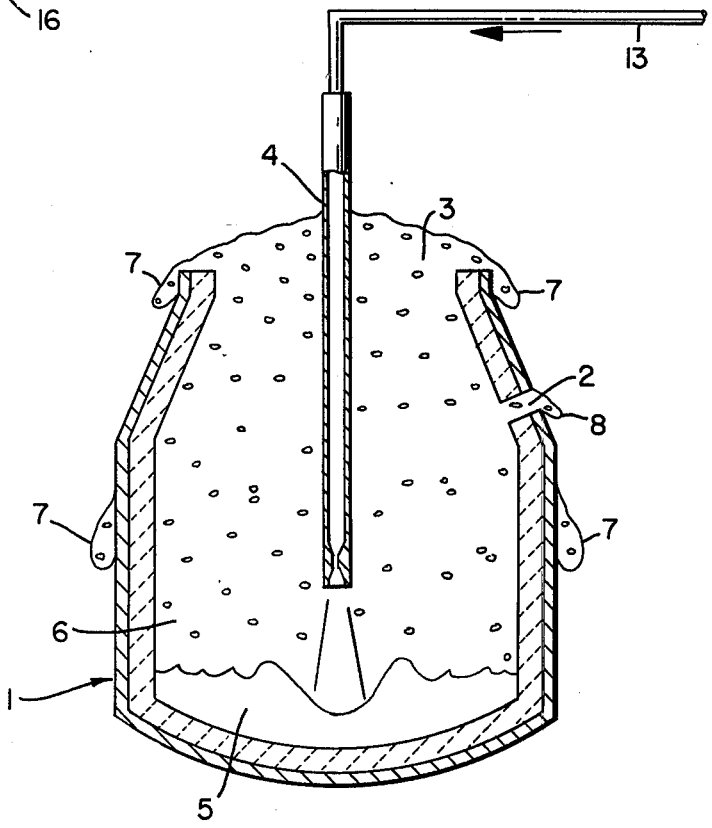
FIG. 2 illustrates a basic oxygen vessel that is slopping during refining.

The total volume of the vessel is several times larger than that of the melt. An important purpose of the extra space in the vessel above the melt, i.e. the vessel's head space, is to contain the emulsion. However, the volume of the emulsion is not easy to control and sometimes becomes larger than the head space, resulting in sloping, as shown in FIG. 2. Here the level of the emulsion has risen above mouth 3. Waves 7 of emulsion overflow mouth 3 and flow down the outside wall of vessel 1, reducing yield, creating a safety hazard and requiring clean-up. Of course, during slopping, emulsion 8 can also leave the vessel through tap hole 2.

The carbon removal rate, and consequently CO evolution, as a function of time follows a generally bell shaped curve during the oxygen blow. This is so because early in the blowing period most of the oxygen reacts with metallic impurities such as silicon in preference to carbon. The liquid and solid oxides thus produced enter the slag phase. After the metallic impurities are substantially oxidized, more oxygen is available for and reacts with carbon in the melt, causing greater CO evolution. The CO bubbles combine with the slag to form the emulsion. During the latter stage of the blow, as the carbon content of the melt decreases, the carbon removal rate and CO evolution decreases, and the emulsion subsides. It is during the stage of greatest CO evolution that slopping is most likely to occur.

To practice the invention, inert gas must be blown into the vessel at the right time and in the proper amount. This is preferably accomplished by connecting an inert gas supply line 15 to oxygen supply line 13 so that the inert gas is blown through the oxygen lance admixed with oxygen. Alternatives such as use of separate lances for the oxygen and inert gas or use of separate passages for inert gas and oxygen in the same lance are believed to be acceptable. The preferred inert gas piping disclosed for use in the present invention is the same as described in Thokar et al, U.S. patent application Ser. No. 880,562, filed Feb. 28, 1978, now U.S. Pat. No. 4,149,878.

Thokar et al discloses a method of producing low-nitrogen, low-oxygen steel by blowing inert gas into the melt during the latter stages of decarburization, more specifically, by introducing argon into the BOF vessel from a time before the nitrogen content has reached its minimum level and continuing the argon until the end of the oxygen blow. Thokar et al will not likely experience slopping during the stage of the blow when argon is being injected, however, they may still experience slopping during the earlier stages of the blow when no argon (or nitrogen free fluid) is being injected, and CO evolution is high. It is during this the stages of high CO evolution, when Thokar et al do not introduce argon, that slopping is most likely to occur.

The preferred and most effective inert gas examined for use in practicing the invention is argon because it is relatively inexpensive, generally available, free of undesirable contaminants, and has low heat capacity. However, other gases such as nitrogen, neon, xenon, radon, krypton, carbon monoxide, carbon dioxide, steam, ammonia, or a mixture thereof are technically acceptable substitutes. It will be obvious to those skilled in the art that when nitrogen is to be used as the inert gas in the practice of the present invention, air may be used in its place, since air is about 79% $N_2$, 1% argon and 20% oxygen. Since oxygen blowing is continued during the inert gas addition, the small excess of oxygen introduced by the air will not adversely effect the refining process.

The inert gas must be introduced in an amount sufficient to lower the level of the emulsion. The required flow rate may vary with different basic oxygen (BOF) refining systems. An inert gas rate of from 5 to 30 percent of the oxygen rate is the preferred range.

The timing of inert gas introduction is critical for practice of the present invention. As soon as slopping occurs, one should immediately introduce inert gas into the vessel, while continuing to blow oxygen, and continue inert gas introduction until slopping has ceased or is no longer believed imminent, i.e. after the danger of slopping is believed to be over. Timely halting of the flow of inert gas is also important, since unnecessary continuation of its introduction will waste inert gas and lower the height of the emulsion with the result that the efficiency of the oxygen refining reaction is unnecessarily reduced.

Preferably, the invention may be used to prevent slopping instead of merely stopping slopping after it has occurred. This can be accomplished by introducing argon into the vessel when slopping is believed imminent. Imminency of slopping may be detected by ejection of small amounts of emulsion from the tap hole of the vessel. As soon as any emulsion spills from the tap hole, inert gas should be introduced in accordance with the invention. The inert gas introduction may be stopped when emulsion stops flowing from the tap hole.

EXAMPLES

The following examples will serve to illustrate the method of practicing the invention. All heats were made in a basic oxygen refining system having the following characteristics:

| | |
|---|---|
| Vessel volume: | 5000 ft.$^3$ |
| Vessel mouth area: | 95 ft.$^2$ |
| Tap weight of heat: | 235 tons |
| Inert gas used: | Argon |

The three heats shown in Examples 1 and 3 are representative of 10 test heats during which an attempt was made to stop slopping by the prior art technique of merely reducing the oxygen blowing rate, i.e. without practicing the present invention.

EXAMPLE 1

Slopping first became visible after 9 minutes of blowing at the rate of 18,200 SCFM of oxygen. The oxygen flow rate was reduced to 16,200 SCFM after the melt had been blown for 9 min. and 10 sec. Slopping slowed by 10 min. and 30 sec., i.e. 1½ minutes after it has started, then became worse. Slopping finally stopped at 12 min. and 30 sec., of elapsed blowing time, i.e. 3½ minutes after it had started. To prevent the recurrence of slopping, the low oxygen flow was maintained until the end of the blow, thereby increasing production time for this heat.

EXAMPLE 2

Mild slopping started after 7 min. and 30 sec. of blowing at an oxygen flow rate of 18,600 SCFM, at which time the oxygen rate was reduced to 15,000 SCFM. However, slopping continued, became worse at 9 min. and 15 sec., and finally stopped at 11 min. and 25 sec. The oxygen flow rate was then gradually restored to 18,800 SCFM by 13 min. and 20 sec.

EXAMPLE 3

Severe slopping started suddenly after blowing at the rate of 18,200 SCFM of oxygen for 13 min. and 10 sec. The oxygen flow rate was reduced to 15,500 SCFM after 14 min. and 30 sec. of flowing time had elapsed. Slopping stopped in 1 to 1½ minutes after the oxygen flow rate was reduced. Oxygen was blown at the reduced rate for a total of 2½ minutes.

Of the ten heats during which an attempt was made to stop slopping by reducing the oxygen flow rate, slopping stopped within 1½ minutes only during two of the heats. Slopping continued for more than 1½ minutes in the other eight heats, and slowed the production rate of all ten heats.

Examples 4 to 6 are illustrative of the present invention to control slopping.

EXAMPLE 4

Slopping started after 15 min. and 25 sec. of elapsed oxygen blowing, at which time argon was introduced into the vessel through the oxygen lance at a flow of 3300 SCFM, while blowing with oxygen continued at 18,200 SCFM. Slopping ceased in less than 20 seconds, at which time the argon was turned off.

EXAMPLE 5

Severe slopping was noted at about 13 minutes into the oxygen blow. Argon was then injected into the vessel as before at a rate of 4000 SCFM. Slopping ceased in five seconds. The argon flow was stopped one minute.

EXAMPLE 6

Slopping was observed after 13 minutes of oxygen blowing, at which time argon was injected as before at the rate of 3200 SCFM. Almost immediately slopping ceased. The argon was left on for one minute, then turned off. Slopping started again, and was again stopped by introducing argon as before. Since it appeared that slopping remained imminent, the second argon injection was continued for three minutes.

It can be seen that the present invention stopped slopping within a matter of seconds, while the prior art method of reducing the oxygen flow rate required several minutes to accomplish the same objective. Cutting down the time is a significant accomplishment not only in terms of the speed with which slopping is stopped, but also because it does so without loss of production time. Furthermore much less metal was lost and much less clean-up was required by the present invention because slopping was stopped more quickly.

What is claimed is:

1. In a process for refining molten steel contained in a vessel by blowing oxygen into the melt from above the melt surface whereby an emulsion is formed above said surface, the improvement comprising:

preventing slopping of said emulsion from said vessel by:

(a) blowing an inert gas into the vessel when slopping is imminent or has begun, at a flow rate sufficient to stop slopping, while continuing to blow with oxygen, and (b) ceasing the blow of inert gas into the vessel when slopping has stopped or is no longer imminent.

2. The process of claim 1 wherein the inert gas is argon.

3. The process of claim 2 wherein the inert gas is blown into the vessel admixed with the oxygen, through the oxygen lance.

4. The process of claims 1, 2 or 3 wherein the inert gas is blown into the vessel at a flow rate of from 5 to 30 volume percent of the oxygen flow rate.

5. The process of claim 1, 2 or 3 wherein a substantially constant oxygen flow is maintained throughout the refining process.

6. The process of claim 1,2, or 3 wherein the inert gas blow is commenced immediately after slopping has begun.

* * * * *

UNITED STATES PATENT AND TRADEMARK OFFICE

CERTIFICATE OF CORRECTION

PATENT NO. : 4,210,442

DATED : July 1, 1980

INVENTOR(S) : J.B. Lewis III, P.P. Kelley

It is certified that error appears in the above-identified patent and that said Letters Patent are hereby corrected as shown below:

In the Specification:

Column 5, line 15, "flowing" should read -- blowing --.

Column 5, line 40, "stopped one" should read -- stopped after one --.

Signed and Sealed this

*Thirtieth* Day of *December 1980*

[SEAL]

*Attest:*

SIDNEY A. DIAMOND

*Attesting Officer*

*Commissioner of Patents and Trademarks*

UNITED STATES PATENT AND TRADEMARK OFFICE

CERTIFICATE OF CORRECTION

PATENT NO. : 4,210,442

DATED : July 1, 1980

INVENTOR(S) : J.B. Lewis, III et al

It is certified that error appears in the above-identified patent and that said Letters Patent is hereby corrected as shown below:

On the front page, in the Assignment Data, after "N.Y." insert --and National Steel Corporation, Pittsburgh, Pennsylvania.--

Signed and Sealed this

*Third* Day of *December 1985*

[SEAL]

*Attest:*

DONALD J. QUIGG

*Attesting Officer*

*Commissioner of Patents and Trademarks*